United States Patent [19]

Schneider

[11] 4,071,061

[45] Jan. 31, 1978

[54] ON-SITE CONSTRUCTION OF ROOF TRUSSES

[76] Inventor: Fredric H. Schneider, 4521 Merrill Ave., Oakland, Calif. 94619

[21] Appl. No.: 734,335

[22] Filed: Oct. 20, 1976

[51] Int. Cl.[2] ..... B25H 5/00

[52] U.S. Cl. ..... 144/314 R; 29/432; 83/581; 100/DIG. 13; 144/288 C; 227/152; 269/321 F

[58] Field of Search ..... 100/DIG. 13; 227/152; 29/432, 2; 144/288 R, 288 C, 314 R, 309 R, 309 L, 318; 269/321 F; 83/581, 745

[56] References Cited

U.S. PATENT DOCUMENTS

| | | | |
|---|---|---|---|
| 2,983,292 | 5/1961 | McKinley | 144/288 C |
| 3,241,585 | 3/1966 | Jureit | 144/288 C |
| 3,410,324 | 11/1968 | Thompson | 83/581 X |
| 3,752,467 | 8/1973 | Stanley | 144/288 C |
| 3,915,444 | 10/1975 | Moehlenpah | 144/288 C |

*Primary Examiner*—Donald R. Schran
*Assistant Examiner*—W. D. Bray
*Attorney, Agent, or Firm*—C. Michael Zimmerman

[57] ABSTRACT

Apparatus is described which makes use of a roof truss as both an assembly surface and sawing table for the construction of additional roof trusses which conform thereto. The apparatus includes the first roof truss as a truss template, and various positioning guides, stops and clamps which are releasably securable thereto to hold and locate lumber pieces during the formation of additional roof trusses.

19 Claims, 9 Drawing Figures

ON-SITE CONSTRUCTION OF ROOF TRUSSES

BACKGROUND OF THE INVENTION

The present invention relates to the construction of roof trusses for frame buildings and, more particularly, to a method and apparatus which simplifies the construction of such trusses so that they can be easily constructed at the building site at which a building requiring the same is being erected.

A frame building roof truss is the structural framework which supports a roof on the sidewalls of the building. A plurality of such roof trusses or frameworks are typically required for each building, which trusses must conform quite accurately to one another to be able to evenly support the load of the roof. Typically, though, roof trusses include angled joints and the like which are not easily made on-site with the accuracy that is required. For this reason, it is the general practice now to order trusses from a manufacturing plant which is especially equipped to prefabricate the same with the accuracy required. The equipment required at the plant is fairly expensive and generally complicated. That is, special saw and measuring table arrangements are typically provided to pre-cut the individual pieces of the desired trusses to the correct specifications. The pre-cut pieces are then transported to a truss assembly table having specially adjusted stops and the like to properly position the truss pieces for fastening together.

The necessity of having roof trusses made at a separate location and then transported to the site at which a building is being constructed is less than satisfactory. It is not unusual for a contractor to reach that construction stage requiring roof trusses without having received the same from the manufacturer. Also, any erroneously constructed roof trusses generally must be sent back to the factory to be corrected, with the result that the construction job is delayed. Delay, especially in the construction industry, costs money.

SUMMARY OF THE INVENTION

The present invention provides a method and apparatus for accurately constructing roof trusses which is so simple and easy to use that on-site construction of the trusses is now quite feasible. In its basic aspects, the apparatus of the invention comprises a truss template which includes members defining the roof and base chords of the desired trusses. Such members have the length and angular relationship to one another of the roof trusses to be constructed. Chord alignment and positioning members are secured to the template adjacent each end of it to position appropriate lumber guides for lumber pieces overlying the template chord members for forming a truss angled end joint therebetween. Lumber positioning stops are also provided secured directly to the template chord members at locations spaced therealong to position lumber along the length of such template members aligned therewith. The template itself then provides an assembly surface supporting member for construction of the truss chords, as well as defines the length and angular relationship of such chords.

The use of the truss template with the end positioning guides and lumber positioning stops directly secured thereto eliminates the necessity of making length and angle measurements during the actual construction of trusses — this is automatically accomplished by the guides and stop on the truss template. While care must be taken in constructing the truss template to make sure it has the desired truss specifications, the time involved in constructing it is more than made up by the savings in constructing the trusses themselves.

Most desirably, the apparatus further includes a saw guide which defines a path for a lumber saw across a portion in the apparatus at which an angled end joint for a truss is to be formed, for cutting a first piece of lumber for an angled end joint between the same and an adjoining truss chord. The saw guide is parallel to the other chord of the truss, with the result that the cut made by the saw automatically is at the correct angle for the end joint. Preferably, the lumber end positioning guides and saw guide at each end of the truss template are arranged to position and effect the saw cut when two pieces of lumber from which an angled end joint is to be formed overlap one another so that after the cut, the pieces of lumber fit together at the same location for assembly into the angled end joint of the desired truss. Thus, the truss template provides at a single location an assembly surface at which the lumber can be cut as well as fastened together to form the truss.

The truss template preferably is itself a roof truss conforming to the configuration and construction of additional roof trusses which are desired, and the lumber end positioning guides and lumber positioning stops are releasably secured thereto for removal after construction of the additional roof trusses. Thus, the care which must be taken in constructing the truss template according to the building plans need not be wasted — it is a roof truss which is being constructed.

The method of the invention includes the steps of releasably securing lumber end positioning guides and stops to a previously constructed roof truss, placing in such guides and stops pieces of lumber overlying the chords with the ends of the lumber pieces overlapping at the truss joints, sawing through both of the overlapped ends of the lumber pieces at the peak joint to form a peak joint therebetween, sawing through one of the overlapped ends at each of the angled end joints to form a truss angled end joint therebetween and fastening together the pieces of lumber to form the truss. Thus, the method comprehends the steps necessary to use a previously constructed roof truss as a single work surface to both saw and fasten together pieces of lumber which form an additional truss.

The invention includes other features and advantages which will become apparent from the following more detailed description of a preferred embodiment.

DETAILED DESCRIPTION OF THE DRAWINGS

With reference to the accompanying five sheets of drawings.

DETAILED DESCRIPTION OF THE PREFERRED EMBODIMENT

Figure 1:
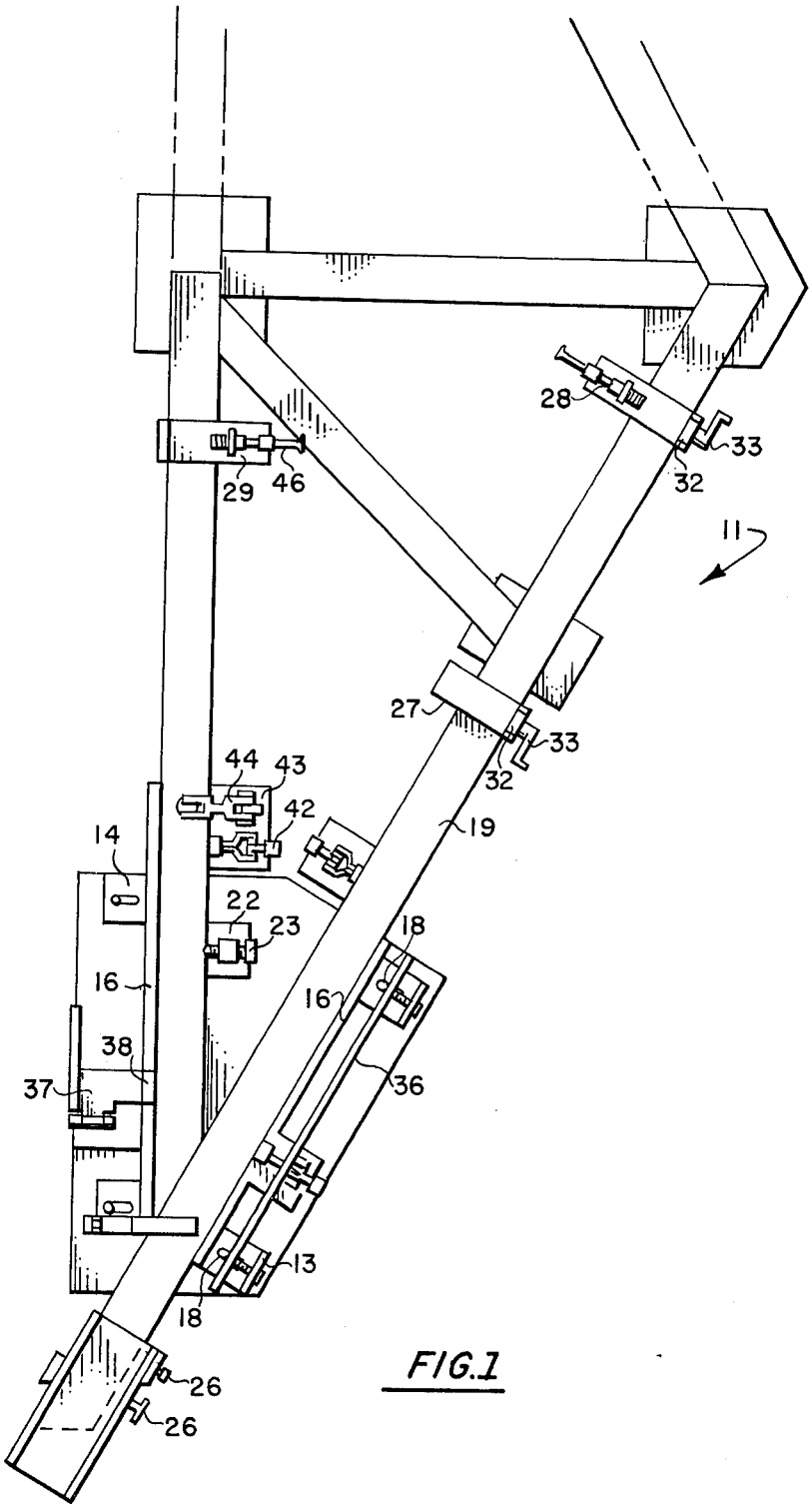
FIG. 1 is a plan view illustrating one half of a preferred embodiment of the apparatus of the invention, it being understood that the other half indicated in phantom is substantially a mirror image of that half illustrated.
Figure 2:
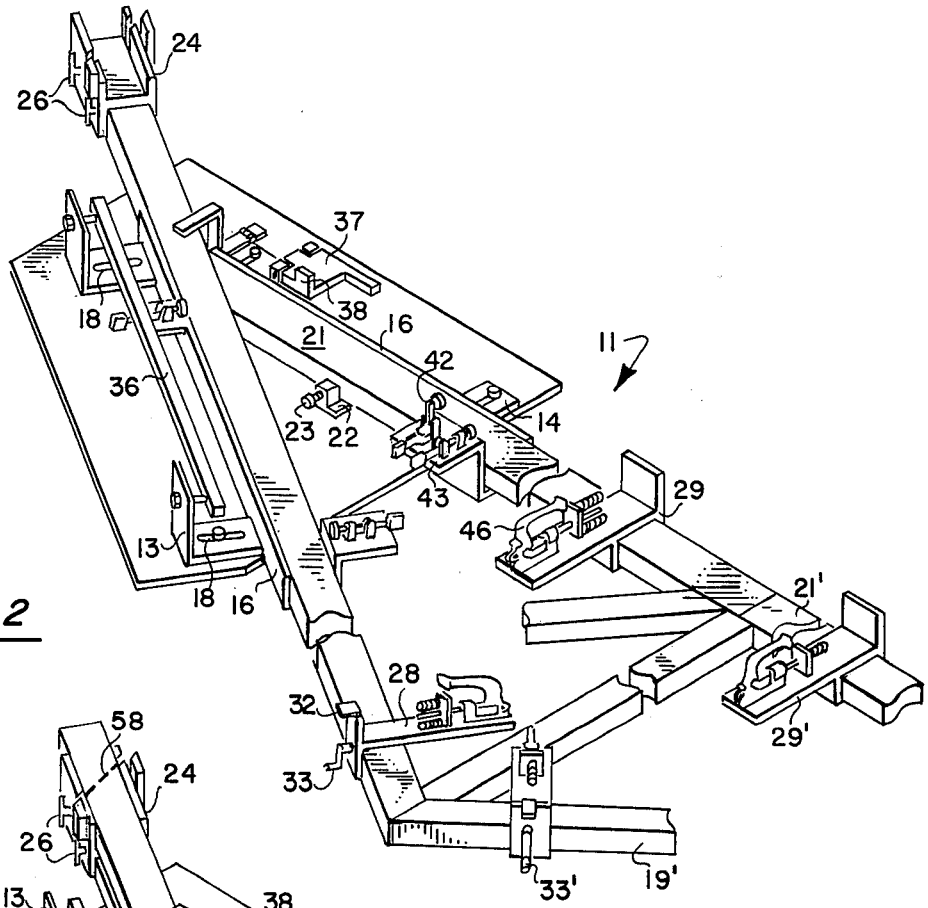
FIG. 2 is an isometric broken view of the preferred embodiment of FIG. 1 illustrating in some detail the lumber stops and the chord alignment and positioning members secured to a roof truss to be used as a truss template for construction of additional roof trusses.

Reference is first made to FIGS. 1 and 2 which partially illustrate the apparatus of the invention ready to construct roof trusses. As a particularly salient feature of the invention, the major component of the apparatus is a truss template, generally referred to by the reference numeral 11, which itself is a roof truss conforming to the trusses desired to be built. Such truss is built directly by workmen from the building plans and specifications. While care must be taken during its construction to assure that it meets the building specifications, the time involved in constructing this first truss is usually more than compensated for by savings of time in constructing the additional roof trusses which conform thereto. In this connection, typical residences often include more than twenty identical trusses.

In FIG. 1, generally one-half of the apparatus of the invention is illustrated. That is, the roof truss is shown between one outer end thereof where it is to engage the wall frame of a building and its center strut. The other half of the roof truss and other components of the apparatus are mirror images of that illustrated except to the extent noted below. Those illustrated aspects of the half of the apparatus not shown in its entirety are referred to by primed reference numerals corresponding to the reference numerals used with that half shown.

Figure 3:
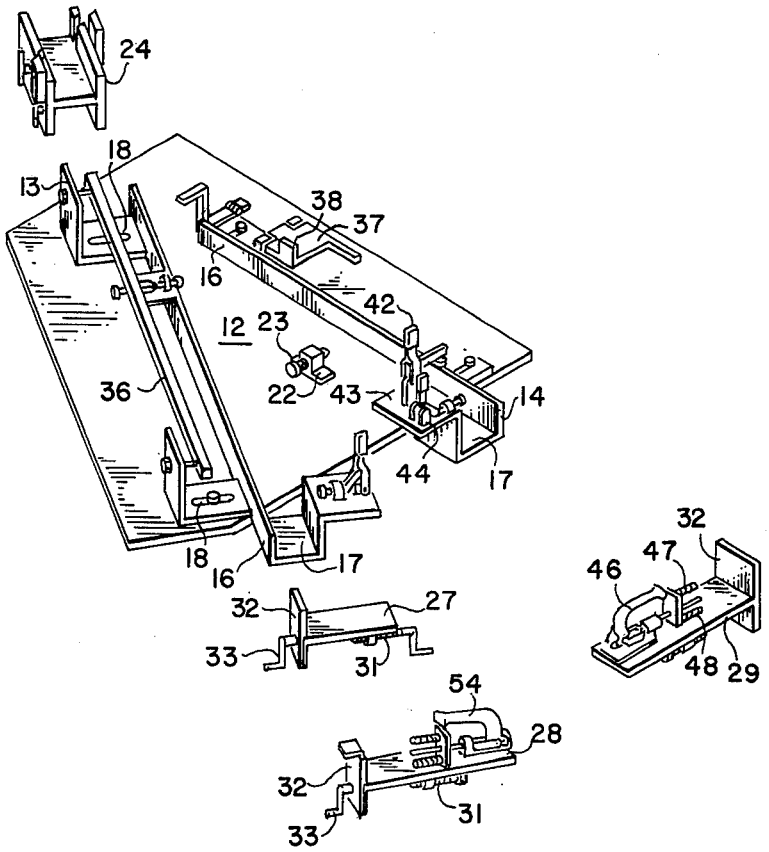
FIG. 3 is an exploded view of the apparatus of FIG. 2, with the truss template removed.

The remaining components of the invention are designed to cooperate with the truss 11 in manufacture of the additional trusses. To facilitate an understanding of such apparatus, FIG. 3 is included showing, without the truss, the apparatus which is secured to one of its halves. Such apparatus includes a supporting base plate 12 to which a pair of chord alignment and positioning members 13 and 14 are secured for the roof and base chords, respectively, of the truss template. In this connection, each of such members 13 and 14 includes an alignment rail 16 adapted to mate with the outer side surface of its associated chord of the truss template. Moreover, each includes a saddle bracket 17 shaped to receive its associated chord template.

To enable the apparatus to be used with truss templates having difficult angles between their base and roof chord defining members, the members 13 and 14 are selectively adjustable angularly with respect to one another. To this end, the member 13 is secured adjacent each of its ends to the base 12 via a slot and bolt arrangement 18 which permits its opposite ends to be moved relative to such plate and, hence, relative to the member 14.

The positioning of the members 13 and 14 is determined by the truss template. That is, the position of such members on the plate 12 is adjusted so that the apparatus will fit on the end of the selected truss template adjacent the angled end joint between the roof and base chords 19 and 21 of such truss template. Means are provided for maintaining the plate 12 and the members 13 and 14 on the template. More particularly, a bracket 22 secured to such base threadably receives a catch bolt 23 which can be threaded to bear against the side of chord 21 opposite the side against which the rail 16 bears in order to frictionally engage or penetrate the same.

As will be described hereinafter, members 13 and 14 position various components of the apparatus at the requisite locations for use of the truss 11 for both a truss template and assembly surface. Other components of the apparatus used for this purpose are secured directly to the truss template. For one, a mitre box 24 releasably secured to the free end of the roof chord of the template truss defines the saw path desired for cutting the free ends of the roof chords, the so-called rafter "tails", of additional roof trusses. The mitre box includes a downwardly opening box channel which receives the end of the roof chord, and a pair of manually adjustable clamp bolts 26 which securely fasten such mitre box in position on the template truss by frictionally engaging the roof chord.

The apparatus further includes lumber positioning stops 27–29 secured directly to the truss template chords adjacent the locations at which web and center post struts are to be secured to the chords of additional trusses during construction of the latter. The lumber positioning stops act to position lumber along the length of the template chords for the construction of chords of additional templates and facilitate, as will be discussed below, the securance of such chords of the web and center post struts.

Each of the stops 27–29 includes on its lower facing surface a manually adjustable clamp bolt 31 for releasably securing the same to its associated template chord. Each of the stops 27–29 also includes a lumber engaging stop portion in the form of an upwardly extending flange 32 engagable with the outer side surface of the piece of lumber which makes the chord of a truss being constructed on the truss template.

As one feature of the instant invention, the lumber positioning stops 27–29 are designed to facilitate the removal from the apparatus of a truss constructed with the use of the underlying truss 11. That is, each of the lumber positioning stops 27 and 28 secured to the roof chord defining member 19 of the truss template includes means for retracting the flange stop 32 thereof from its stop position. As easily seen in FIGS. 3, 7, 8 and 9, the flange stop 32 of each of such lumber positioning stops is secured to the remainder of the stop by a threaded bolt having a crank head 33. Unthreading of the crank bolt enables the flanges 32 of the lumber positioning stops 27 and 28 to be moved outward away from any lumber against which they bear and thus release any grip they and opposed positioning stops on the base chord 21 have on a finished truss. The flange stop 32' of the lumber positioning stops which are secured to the roof chord defining member 19' of the half of the apparatus not illustrated in full are also retractable in the same manner. It will be recognized, of course, that the means for retracting flange stops could just as easily be provided, alternatively or additionally, as part of the positioning stops secured to the base chord of the truss template.

To facilitate understanding, those components of the invention already discussed above, as well as additional components thereof, will be described in more detail in connection with the following description of use of the invention to construct trusses.

As mentioned previously, it is first necessary to construct a roof truss with measurements, angular relationships, etc., taken directly from the plan specifications for the building being erected. The complete truss then becomes a template for constructing additional roof trusses corresponding thereto, i.e., having the length and angular relationships of the previously constructed truss. To this end, the supporting plate 12 with chord alignment and positioning members 13 and 14 are appropriately secured to the truss template as previously discussed, and the mitre box 24 and lumber positioning stops 27–29 are secured directly to the truss template as stated.

Before pieces of lumber for the chords of an additional truss are placed on the truss template, steel back-up plate 34 (FIGS. 4 and 6) are placed on the truss template overlapping the location of each of the joints to be made. These steel plates are used when lumber pieces are fastened together in a conventional manner for the additional trusses to turn over the ends of nails which are forced through conventional tie plates at the joints. In this connection, the lower tie plates (not shown) for each of the joints of the truss to be constructed are placed on top of the back-up plates at the joint locations.

Figure 4:
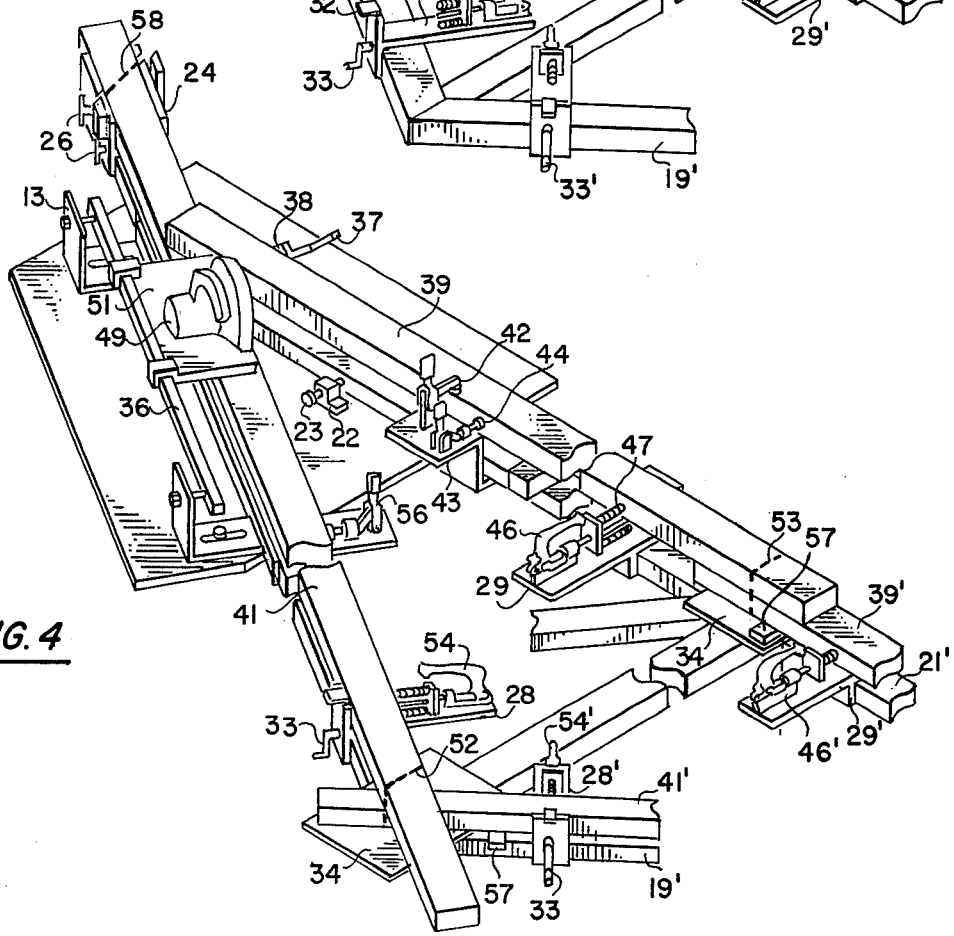
FIG. 4 is an isometric view similar to FIG. 2 illustrating lumber positioned in the apparatus for the construction of a truss.

Pieces of lumber for the chords of the truss to be constructed are then placed in the lumber positioning stops, overlying the chords of the truss template 11 with the ends of the lumber pieces overlapping one another at the peak and angled end joints of such truss template. This lumber piece-apparatus relationship is best illustrated in FIG. 4. The next step is to saw the lumber pieces for the chords at the appropriate locations to form the desired chords. The apparatus of the invention facilitates such sawing as well as provides an assembly surface for truss construction. In this connection, the apparatus enables such sawing to take place directly on the truss template, with the truss template defining the appropriate sawing locations without measurements being made.

The more critical saw cuts in the formation of a truss are those made in forming the angled end joints between the base chord and each of the roof chords. It is important that such cuts fairly closely follow the angles between the roof and base chords since it is at such cuts that a significant portion of the compressive load of a roof is transmitted between such roof and base chords. The apparatus includes an arrangement which permits the angled end joint saw cuts to be made quite accurately in a very simple manner. That is, one of the components positioned by the chord alignment and positioning member 13 is a saw guide rail 36 mounted parallel to the alignment rail 16 of such member. Thus, when the alignment rail 16 is positioned against the outside side surface of the associated roof chord of the truss template, the rail 36 is automatically positioned not only parallel to such truss template but parallel to the direction at which a saw cut must be made in a piece of lumber to form the angled end joint between a base chord and the roof chord of an additional truss being constructed.

The apparatus includes an arrangement for properly positioning and holding lumber during the sawing operations. That is, the chord alignment and positioning member 14 includes a lumber positioning guide at the angled end joint for the piece of lumber which is to form the base chord. More specifically, a plate 37 pivotally mounted on the support plate 12 has a guide flange 38 extending upwardly therefrom. As illustrated in FIG. 4, the plate 37 is pivotable upward to position the flange 38 in position to act as a guide or stop for the end of a piece of base chord lumber 39 having its ends overlapping lumber pieces 39' and 41 which are provided to make the other half of the base chord and a roof chord, respectively. Releasable holding means is provided for maintaining the piece of lumber 39 in position during cutting of the same. That is, a releasable hold-down clamp 42 on a base flange 43 extending horizontally inward from saddle bracket 17 on positioning member 14 is engageable with the top surface of the lumber piece 39 to resiliently urge the same downward against the pieces of lumber 39' and 41 that it overlaps. Moreover, releasable pressure clamps 44 and 46 provided respectively on the base flange 43 and the positioning stop 29 resiliently urge the piece of lumber 39 against the guide flange 38 and the flange stop 32 of the positioning stop. For reasons which will be discussed in more detail hereinafter, releasable clamp 46 includes two vertically separated plungers 47 and 48. When the lumber piece 42 is in the overlapping position illustrated, it is the upper plunger 47 which engages the lumber piece and urges it against the flange stop 32 as aforesaid.

Figure 5:
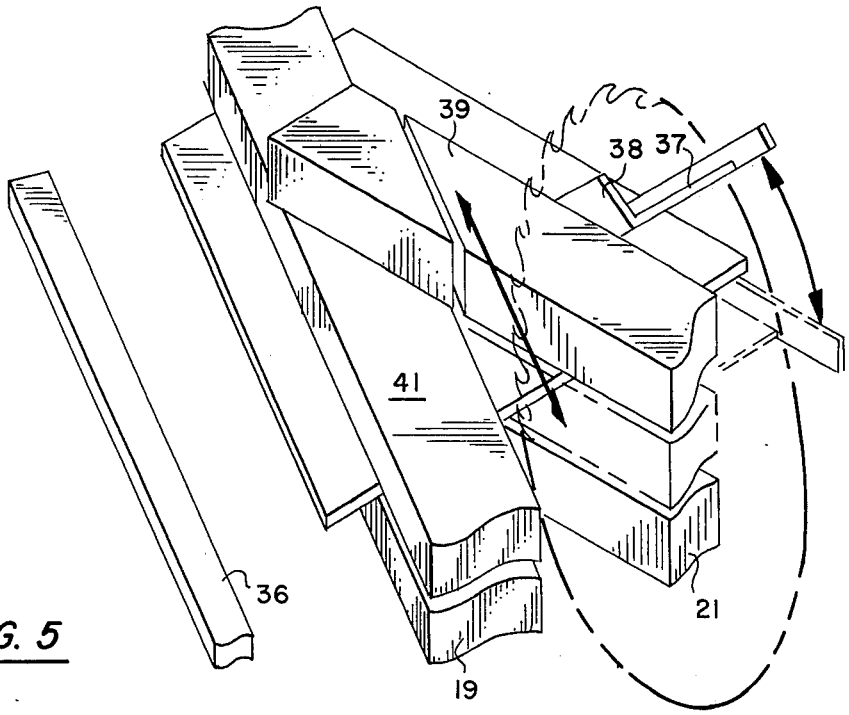
FIG. 5 is an enlarged partial view illustrating the manner in which lumber is cut to form an angled end joint between the chords of a truss being constructed.

After the hold-down clamp 42 and the releasable pressure clamps 44 and 46 are actuated, the angled saw cut for the angled end joint can be made at the proper position and angle for the truss being constructed. That is, to saw the angle, it is simply necessary to guide a saw along the saw path defined by the guide rail 36. This will result in the base chord end being cut at the appropriate angle and location. Since it is the base chord piece of lumber 39 which is cut, the lumber piece 41 which is to form the roof chord at the angled end joint need not be positioned exactly at this time. The saw 49 which makes the cut is mounted on a guide plate 51 which coacts with the rail 36 to define the saw path at the proper angle and location for the angled end joint. FIG. 5 is an enlarged view depicting the saw cut for the angled end joint after it is made, and its relationship to the saw guide rail 36.

The above procedure is repeated at the other end of the apparatus to form the angled end joints saw cut at the other end of the truss being constructed. It should be noted that the lumber piece 39' which will have such other angled end joint saw cut is not in the position it will finally take in the finished truss. That is, the end thereof abutting a lumber piece 39 will be generally adjacent the truss template 11, whereas the end thereof to be cut will be overlapped by the lumber piece 41' forming the other roof chord. The resulting slight angular offset in the saw cut at the angled end joint is generally not of material significance in view of the length of the finished base chord.

The saw cuts at the center of the base chord and at the juncture of the roof chords are the easiest to make. Mating joints are simply formed by simultaneously sawing through the overlapped ends of the lumber pieces at the peak and base chord joints. The respective saw path locations are indicated in FIG. 4 by the dotted lines 52 and 53. Before saw cut 52 is actually made, pressure clamps 54 and 54' respectively on the positioning stops 28 and 28′ are actuated to properly position the lumber pieces 41 and 41′ for the cut. Also, a pressure clamp 56 on the saddle bracket 17 of the member 13 is actuated to assure that the roof chord lumber pieces 41 and 41′ are properly aligned with the underlying truss template prior to such cut. The saw cuts are then made. Small wooden safety blocks 57 can be positioned between the lower lumber pieces and the truss template to raise the lumber to be cut sufficiently far above the back-up plates 34 to prevent injury to the saw blade during the cuts.

It is also appropriate at this time to cut the rafter tails of the roof chords. The saw path location for the tail cut on the illustrated truss half is represented in FIG. 4 by the dotted line 58 in the mitre box 24.

Once the chord lumber pieces are cut as described, the various pressure clamps are released and the blocks 57 removed to allow the lumber pieces to automatically fall into position for fastening together. In this connection, the overlapping lumber piece 39 will take a new position in a plane common with the lumber pieces 39′ and 41, and the guide flange 38 of the pivotal plate 37 will move downward to act as a guide for lumber piece 39 at this new location. Prior to actually fastening the chord ends together, the center and other web struts are conventionally made and placed in position.

Figure 6:
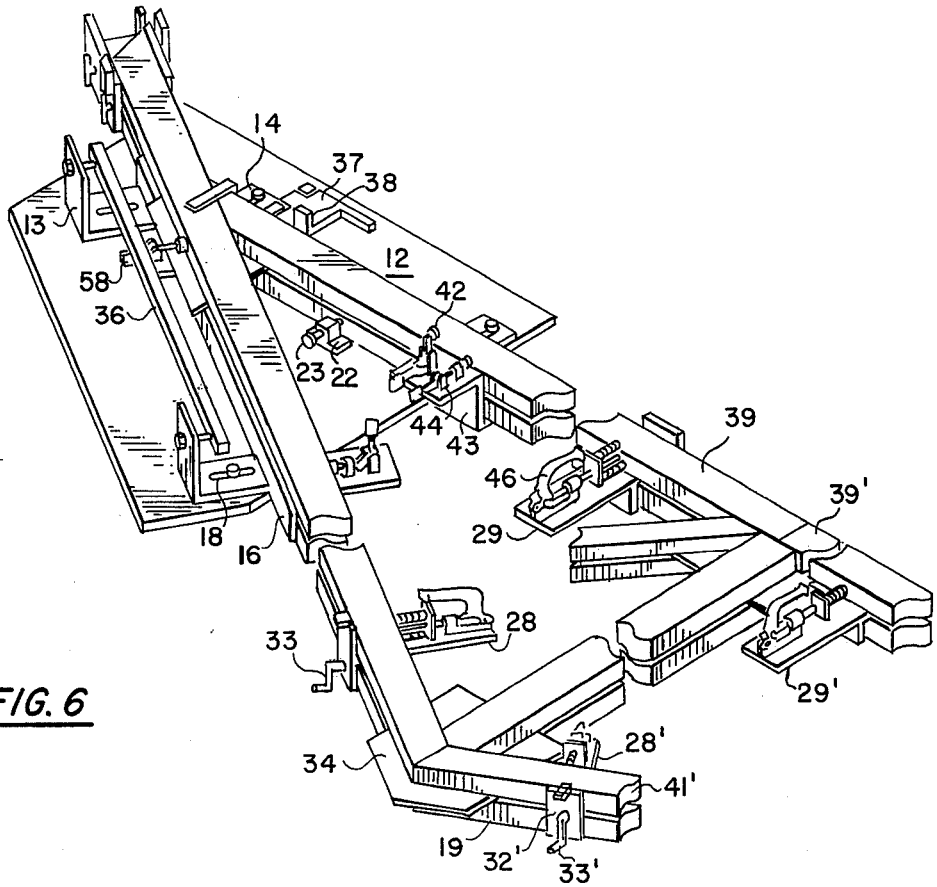
FIG. 6 is another isometric view similar to FIGS. 2 and 4 illustrating lumber in position for securing the same together.
Figure 7:
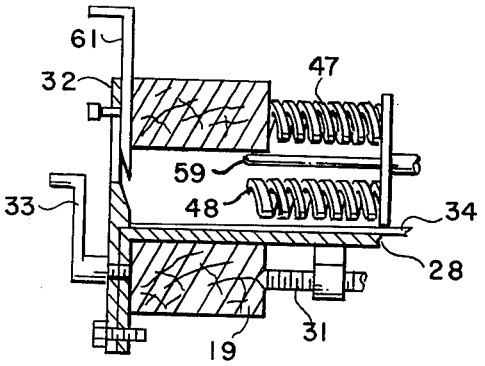
FIG. 7 is an enlarged partial sectional view illustrating certain aspects of a lumber positioning stop of the preferred embodiment.

FIG. 6 illustrates the cut lumber pieces in position to be fastened together to form the additional truss. Conventional tie plates (not shown) are placed over each of the joints of lumber to be secured together. Moreover, the pressure clamps adjacent the joints are again actuated to properly position the lumber during the fastening operation. In this connection, another pressure clamp 58 is provided adjacent the angled end joint for pressing the lumber pieces 39 and 41 together at the joint during the fastening operation. The fastening operation is then conventionally carried out by nailing the tie plates to the lumber pieces.

As noted previously, the pressure clamp 46 on the positioning stop 29 secured to the base chord of the truss template adjacent its center has a pair of vertically separated plungers 47 and 48. As can be seen from FIG. 3, pressure clamp 54 on stop 28 also has such a pair of vertically separated plungers 47 and 48. The upper plunger 47 of each of such pressure clamps is positioned to engage a lumber piece from which a truss is being constructed when the lumber piece is in an upper position overlapping another lumber piece as illustrated in FIG. 4. The lower plunger 48 of each is poisitioned to engage the lumber along its associated chord of the truss template when such lumber is in the lower position illustrated in FIG. 6.

As an important safety feature of each of the pressure clamps, a rigid safety finger 59 is positioned between the plungers 47 and 48 of each of such pressure clamps. One of the primary purposes of the safety finger 59 is to alert an operator when he has inadvertently failed to insert a safety block 57 (FIG. 4) between the lower lumber piece and the truss template at the clamp location. That is, when the wooden blocks which raise the lumber pieces above the steel plates 34 for the sawing operation are inadvertently omitted, the lumber piece to be cut will be lower, with the result that it will be engaged by finger 59, rather than by the plunger 47. This will prevent the operator from actuating the pressure clamp and, hence, alert him of the mistake.

The saftey finger 59 of each clamp also will act to prevent the upper piece of lumber from being accidentally forced downward during the cutting operation when the end of the lumber piece which is supporting the same is sawed off. That is, as can best be seen by referring to the positioning stop 29 in FIG. 4, when the cut 53 is made the end of the underlying lumber piece 39′ which is supporting the lumber piece 39 will be allowed to fall, with the result that the lumber piece then is only being supported by the pressure of the clamp 47 forcing the same against the opposed flange stop 32. Any downward pressure applied to the lumber piece 39 at such time will result in the same engaging the top of the spring finger, rather than being allowed to unexpectedly move downward.

Figure 8:
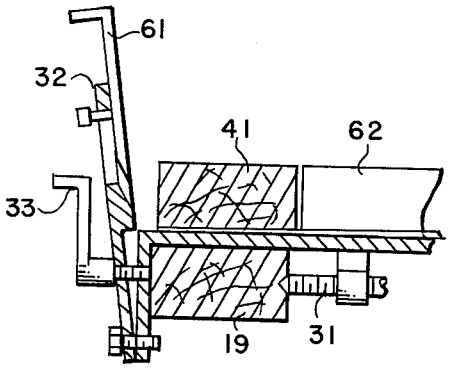
FIGS. 8 and 9 are enlarged partial sectional views of a lumber positioning stop illustrating another feature thereof.
Figure 9:
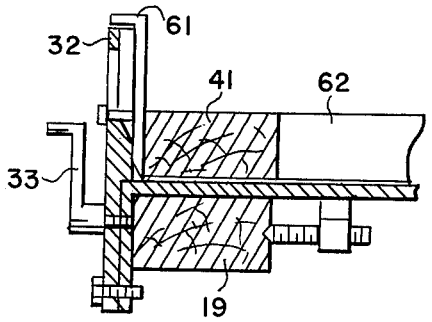

It will be recalled that the center post or strut and the angled web strut are conventionally made. While most often the minimal measurements and saw cuts necessary to form the center strut can be easily made without error, there are times when a center strut is cut slightly shorter in length than is desired. The present invention includes an arrangement which assures that a tight fit is provided between the peak joint of the chords and the center strut during the fastening operation in such situations. That is, the lumber positioning stops 28 and 28′ adjacent the peak joint are designed to permit any gap between the chords and center strut at such location to be closed. With reference to FIGS. 8 and 9 in which stop 28 is shown in section, it will be seen that the flange stop 32 thereof includes a lug 61 having a ramp on its end which coacts with a corresponding ramp on the flange 32 when the lug is moved from the upper position shown in FIG. 8 to the lower position shown in FIG. 9 to cause the lug to protrude. This, in effect, increases the thickness of the guide flange 32. Therefore, when the crank bolt securing the flange stop 32 to the remainder of the stop is tightened with the crank head 33, the lug engages the roof chord lumber piece 41 with which it is associated and forces the same inwardly against the upper end of the center post strut lumber piece 62. Thus, even when the center post strut is cut slightly short, it can be used by moving the peak joint formed between the roof chords downwardly slightly with the protrudable lugs 61 to close any gap between the same and the center strut. It should be noted that it is not necessary to include lugs on the lumber positioning stops adjacent the joints between the angled web struts and the roof chords since any small gap between such struts and chords can be eliminated merely by slightly changing the angle at which the strut meets the roof chord.

After a truss is completed, it can be removed from the apparatus of the invention simply by loosening the pressure clamps and roof chord positioning stops as discussed previously. The apparatus is then ready for the construction of additional truss conforming to the truss template then being used.

Although the invention has beeen described in connection with a preferred embodiment thereof, it will be appreciated by those skilled in the art that various changes and modifications can be made without departing from its spirit. For example, the saw guide arrangement for forming the angled end joints could be separately installed on existing truss assembly tables to convert such tables to combined sawing and assembly table. It is therefore intended that the coverage afforded applicant be limited only by the claims and their equivalent language.

I claim:

1. Apparatus for constructing a roof truss comprising a truss template which includes roof and base chord defining members having the length and angular relationship of the base and roof chords of a roof truss to be constructed; chord alignment and positioning members secured to said template along said chord defining members adjacent each end of said template, at least one of which includes a lumber end positioning guide adapted to position at its associated end of said template a first piece of lumber to be used for forming an angled end joint of a roof truss; and lumber positioning stops secured directly to said template chord members at spaced locations to position lumber along the lengths of said template members, whereby said template provides an assembly surface for supporting lumber for construction of said truss chords, as well as defines the length and angular relationship of said chords.

2. Apparatus for constructing a roof truss according to claim 1 wherein said chord alignment and positioning members adjacent each end of said template are selectively adjustable angularly with respect to one another to correspond the same with the angular relationship of the roof and base chords of differing truss templates.

3. Apparatus for constructing a roof truss according to claim 1 wherein either each of the lumber positioning stops secured to said base chord defining member or each of the lumber positioning stops secured to said roof chord defining member, includes means for retracting the lumber engaging stop portion thereof from its stop position to facilitate the removal from said apparatus of a roof truss constructed from said pieces of lumber.

4. Apparatus for constructing a roof truss according to claim 1 wherein a pair of said lumber positioning stops are respectively secured to each of said roof chord defining members adjacent a peak joint defined therebetween, each of said positioning stops including a protrudable lug engageable with lumber thereat to force the same inwardly against the end of a center post strut positioned thereat.

5. Apparatus for constructing a roof truss according to claim 1 wherein said truss template is itself a roof truss conforming to an additional roof truss to be constructed, and said chord alignment and positioning members and said lumber positioning stops are releasably secured thereto for removal therefrom after construction of said additional roof truss.

6. Apparatus for constructing a roof truss according to claim 5 further including a pair of mitre boxes releasably secured respectively to the free end of each roof chord of said truss template defining a saw path desired for cutting the free ends of the roof chords of said additional truss.

7. Apparatus for constructing a roof truss according to claim 1 further including adjacent each end of the member of said template defining said base chord, a saw guide defining a path for a lumber saw across a first position at which a first piece of lumber is to be maintained for an angled end joint between the same and second piece of lumber for an adjoining truss chord, said path being parallel to said adjoining truss chord.

8. Apparatus for constructing a roof truss according to claim 7 wherein said lumber positioning guide is adapted to define a first position for said first piece of lumber in a plane immediately above and generally parallel to the plane of said adjoining truss chord whereby said first piece of lumber is positioned overlapping said second piece of lumber during travel of a saw along said path, and said lumber positioning guide also defines a second position for said first piece of lumber in which it is generally in a common plane with said second piece of lumber and makes therewith an angle corresponding to the angle of the desired angled end joint for said truss.

9. Apparatus for constructing a roof truss according to claim 8 further including a pressure clamp associated with one of said chord alignment end positioning members for pressing said pieces of lumber together at the joint therebetween during fastening of the same together.

10. Apparatus for constructing a roof truss according to claim 9 wherein said truss template is itself a roof truss conforming to an additional roof truss to be constructed, and said chord alignment and positioning members and said lumber positioning stops are releasably secured thereto for removal therefrom after construction of said additional roof truss.

11. Apparatus for forming an angled end joint between a roof chord and the base chord of a roof truss during the construction of such truss comprising a base structure supporting a lumber end positioning guide at a location defining a first position for a first piece of lumber from which one of said roof chord and base chord is to be formed, and a saw guide on said base structure at a location defining a path for a lumber saw across said first position at the proposed location on said piece of lumber for said angled end joint, said path being parallel to the other of said roof chord and base chord of said truss and the angular relationship of said saw guide relative to said first position defined by said lumber positioning guide being selectively adjustable to form differently angled end joints between roof and base chords of trusses.

12. Apparatus for forming an angled end joint between roof and base chords of a roof truss according to claim 11 further including a first releasable pressure clamp engageable with said lumber on the side thereof opposite said positioning guide to maintain said lumber selectively against said positioning guide.

13. Apparatus for forming an angled end joint between roof and base chords of a roof truss according to claim 12 further including a releasable hold-down clamp engageable with said piece of lumber on a surface thereof generally normal to said side engaged by said first releasable clamp to hold said lumber selectively in a set position relative to a work surface adjacent an opposite side thereof.

14. Apparatus for forming an angled end joint between roof and base chords of a roof truss according to claim 11 wherein said lumber positioning guide is adapted to define said first position for said first piece of lumber in a plane immediately above and generally parallel to the plane of said other truss chord with said first piece of lumber overlapping a second piece of lumber during travel of a saw along said path, and said lumber positioning guide also defines a second position for said first piece of lumber in which it is generally in a common plane with said second piece of lumber and makes therewith an angle corresponding to the angle of the desired angled end joint for said truss.

15. Apparatus for forming an angled end joint between roof and base chords of a roof truss according to claim 14 wherein said lumber positioning guide includes a positioning stop which is hinged to move between a pair of locations respectively defining said first and second positions for said first piece of lumber.

16. Apparatus for forming an angled end joint between roof and base chords of a roof truss according to claim 15 further including a first releaseable pressure clamp engageable with said lumber on the side thereof opposite said positioning guide to maintain said lumber selectively against said positioning guide; and wherein the angular relationship of said saw guide relative to said first position defined by said lumber positioning guide is selectively adjustable to form differently angled end joints between roof and base chords of trusses.

17. A method of constructing a roof truss with chords having the length and angular relationship of a previously constructed roof truss comprising the steps of: releasably securing a lumber end positioning guide to said previously constructed roof truss adjacent each end of the base chord thereof; releasably securing lumber positioning stops to the chords of said previously constructed truss at spaced locations therealong; placing pieces of lumber against said lumber end positioning guide and in said lumber positioning stops overlying said chords of said previously constructed truss with the ends of said lumber pieces overlapping at the peak of said previously constructed truss and at the angled end joints thereof; sawing through the overlapping ends of said lumber pieces at said peak to form a peak joint therebetween; sawing through one of the overlapped ends at each of said angled end joints to form a truss angled end joint therebetween; and fastening together said pieces of lumber to form said truss.

18. The method of constructing a roof truss according to claim 17 further including the step of: positioning adjacent each of said angled end joints of said previously constructed truss, a saw guide which defines a path for a lumber saw across the upper one of said overlapped pieces of lumber, which path is parallel to the other of said pieces of lumber placed at said angled end joint.

19. Apparatus for constructing a roof truss according to claim 10 wherein a pair of said lumber positioning stops are respectively secured to each of said roof chord defining members adjacent a peak joint defined therebetween, at least one of which stops is adapted to define both a first position for a piece of lumber in a plane immediately above and generally parallel to a plane of the adjoining roof chord at said peak, and a second position for said piece of lumber in which it is generally in a common plane with said other piece of lumber and makes therewith an angle corresponding to the angle of the desired peak joint for said truss, and further including a rigid safety finger protruding from said stop to a location between said lumber positions to separate the same.

* * * * *